US007175483B2

(12) United States Patent
Ishikawa

(10) Patent No.: US 7,175,483 B2
(45) Date of Patent: Feb. 13, 2007

(54) CONNECTOR

(75) Inventor: Ryotaro Ishikawa, Yokkaichi (JP)

(73) Assignee: Sumitomo Wiring Systems, Ltd (JP)

( * ) Notice: Subject to any disclaimer, the term of this patent is extended or adjusted under 35 U.S.C. 154(b) by 0 days.

(21) Appl. No.: 11/179,735

(22) Filed: Jul. 12, 2005

(65) Prior Publication Data

US 2006/0025022 A1 Feb. 2, 2006

(30) Foreign Application Priority Data

Jul. 29, 2004 (JP) ..... 2004-222455

(51) Int. Cl.
*H01R 13/514* (2006.01)

(52) U.S. Cl. ..... 439/752

(58) Field of Classification Search ..... 439/752, 439/489

See application file for complete search history.

(56) References Cited

U.S. PATENT DOCUMENTS 6,086,431 A * 7/2000 Konoya et al. ..... 439/752
6,139,375 A * 10/2000 Konoya et al. ..... 439/752
6,358,101 B1 * 3/2002 Noro et al. ..... 439/752
6,368,164 B1 * 4/2002 Nakamura ..... 439/752
6,599,154 B2 * 7/2003 Sakurai et al. ..... 439/752

FOREIGN PATENT DOCUMENTS

JP 6-325814 11/1994

* cited by examiner

*Primary Examiner*—Briggitte R. Hammond
(74) *Attorney, Agent, or Firm*—Gerald E. Hespos; Anthony J. Casella

(57) ABSTRACT

An interference prevention portion (20) is disposed rearward from a retainer (40) and projected from an outer surface of a housing (10). The interference prevention portion (20) is capable of preventing another member from interfering with the retainer (40) when the retainer (40) is at a temporary locking position. Therefore, the interference prevention portion (20) prevents the other member from pressing the retainer (40) into the main locking position. The interference prevention portion (20) is disposed rearward from the retainer (40) at the rear end of the housing (10). Therefore the interference prevention portion (20) does not interfere with an operation for fitting the housing (10) in a mating housing.

9 Claims, 8 Drawing Sheets

CONNECTOR

BACKGROUND OF THE INVENTION

1. Field of the Invention

The present invention relates to a connector having a retainer.

2. Description of the Related Art

Japanese Patent Application Laid-Open No. 6-325814 discloses a connector with a housing that has opposite front and rear ends. Terminal fittings can be inserted the housing from the rear end of the housing. A retainer is mounted on the housing and can be moved at an angle to the terminal inserting direction between a temporary locking position and a main locking position. The terminal fittings can be mounted in the housing or removed from the housing when the retainer is at the temporary locking position. However, removal of the terminal fittings is prevented when the retainer is at the main locking position.

The above-described connector is assembled in steps. More particularly, the retainer is mounted at the temporary locking position in the housing at the site for manufacturing the connector. This sub-assembly of the housing and the retainer then is transported to the site for manufacturing a wire harness. Terminal fittings connected with electric wires are inserted into the housing at the site for manufacturing the wire harness.

Ideally, the retainer will remain at the temporary locking position during transport, and it is unnecessary to displace the retainer to the main locking position to insert the terminal fittings into the housing. Thus the connector can be manufactured at a high efficiency.

A large number of retainer-housing sub-assemblies are transported in boxes or bags to the site for manufacturing the wire harness and there is a possibility that some of these sub-assemblies will collide during transportation. The forces of such collisions may displace some retainers from the temporary locking position to the main locking position. Thus, it is necessary to return the retainer to the temporary locking position. Accordingly, there is a demand for an improvement of the construction of the conventional connector.

The invention has been completed in view of the above-described situation. Therefore it is an object of the invention to prevent a retainer from being pushed inadvertently from a temporary locking position to a main locking position.

SUMMARY OF THE INVENTION

The invention relates to a connector with a housing, terminal fittings and a retainer. The housing has opposite front and rear ends and the terminal fittings are inserted into the housing along an inserting direction from the rear end of the housing towards the front end thereof. The retainer can be mounted on the housing at a temporary locking position where the terminal fittings can be inserted into the housing. However, the retainer can be pressed in a displacement direction to a main locking position where the terminal fittings are held unremovably in the housing.

The connector also includes an interference prevention portion that projects from an outer surface of the housing. The interference prevention portion prevents other members from interfering with the retainer when the retainer is at the temporary locking position. Thus, the connector can be transported with the retainer at the temporary locking position, and other members will not press the retainer into the main locking position.

The interference prevention portion is rearward of the retainer and preferably is substantially flush with the rear end of the housing. Therefore the interference prevention portion does not interfere with fitting the housing in a mating housing.

The interference prevention portion preferably has a cut-out that allows the retainer to be pressed at a position rearward from the retainer when the retainer is at the temporary locking position. The cut-out allows the retainer to be pressed from the temporary locking position to the main locking position.

The displacement direction of a retainer often is orthogonal to the insertion direction of the terminal fittings. However, a retainer of that design could be displaced to the main locking position when a pressing force is applied to the retainer from an obliquely forward position. Accordingly, the displacement direction of the retainer of the subject invention from the temporary locking position to the main locking position preferably is forward and oblique to the insertion direction of the terminal fitting. Accordingly, it is difficult to press the retainer to the main locking position even if a pressing force is applied to the retainer from an obliquely forward position.

DETAILED DESCRIPTION OF THE PREFERRED EMBODIMENTS

Figure 1:
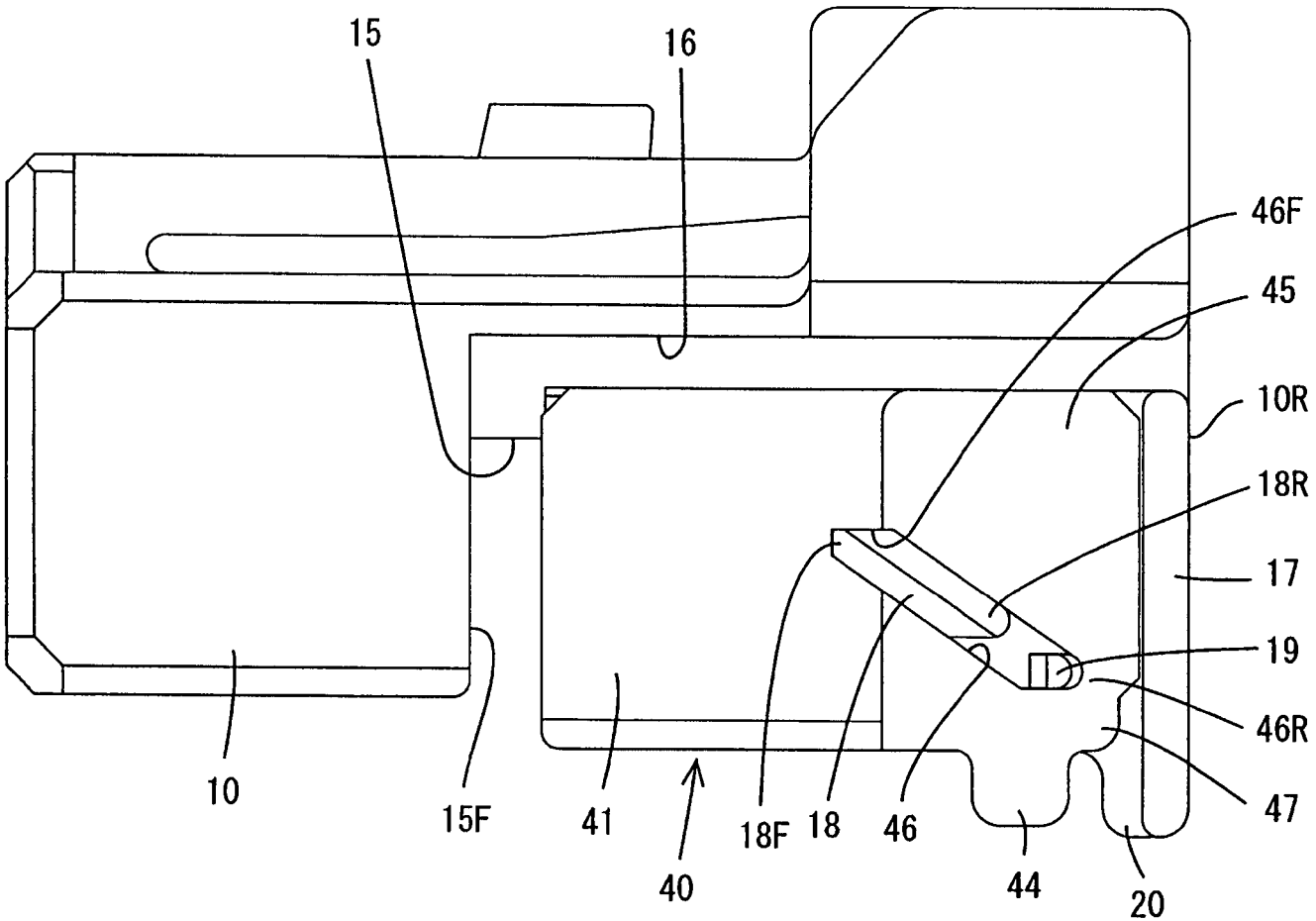
FIG. 1 is a side view showing a state in which a retainer is at a temporary locking position of a first embodiment.

A connector according to the invention has a housing 10, terminal fittings 30 and a retainer 40. The housing 10 is made of synthetic resin and defines an elongate block shape with opposite front and rear ends. Long narrow upper-stage cavities 11A are arranged across a width direction of the housing 10 and long narrow lower-stage cavities 11B are arranged across the width direction below the upper stage cavities 11A. The upper and lower stage cavities 11A and 11B extend into the housing 10 from the rear end towards the front end and tab penetration openings 12 penetrate through a front-end wall of each of the cavities 11A, 11B so that tabs of male terminal fittings of a mating connector can enter the cavities 11A, 11B. A terminal fitting insertion opening 13 is formed at the rear end of each cavity 11A, 11B so that the terminal fittings 30 can be inserted into the cavities 11A, 11B in a rear-to-front direction. A lance 14 is cantilevered forward along a lower wall surface of each of the cavities 11A, 11B.

A mounting space 15 is formed in the housing 10 for accommodating the retainer 40. The mounting space 15 is open over the whole width in a rear region of a lower surface of the housing 10 and communicates with all of the cavities 11A, 11B. The mounting space 15 also is open on left and right side surfaces of the housing 10. The mounting space 15 has the shape of an approximately right triangle in a side elevation. That is, the edge of the opening disposed on the side surface of the mounting space 15 has a linear front edge 15F substantially perpendicular to the insertion direction of the terminal fitting 30 and an almost linear rear edge 15R oblique to the insertion direction of the terminal fitting 30.

A shallow concave rectangular escape portion 16 is formed from the front edge 15F of the opening of the mounting space 15 to the rear end of the housing 10. Protection ribs 17 are formed on left and right side surfaces of the housing 10 along the rear edge of the escape portion 16. The protection ribs 17 are substantially flush and continuous with a rear end surface 10R of the housing 10. The rear end surface 10R of the housing 10 and the protection ribs 17 are perpendicular to the insertion direction of the terminal fitting 30.

Guide ribs 18 are formed on the left and right escape portions 16 and extend substantially parallel with the rear edge 15R of the mounting space 15. Locking projections 19 also are formed on the left and right escape portions 16 at positions below the guide ribs 18 and on an extension of the respective guide rib 18.

An interference prevention portion 20 extends down from the rear edge of the lower surface of the housing 10 at a position flush with the rear end surface 10R of the housing 10. The interference prevention portion 20 extends over the whole width of the housing 10 so that the left and right ends of the interference portion 20 are continuous with the protection rib 17. A cut-out 21 is formed at a widthwise central area of the interference prevention portion 20. The cut-out 21 is trapezoidal in a rear view so that the width of the cut-out 21 becomes gradually larger down towards the lower end of the interference prevention portion 20.

The terminal fitting 30 is long and narrow, and has opposite front and rear ends. A square box-shaped contact 31 is formed at the front end of the terminal fitting 30 and is connected conductively with the tab of the mating connector that has entered the front of the box-shaped contact 31. An electric wire connection portion 32 is formed at the rear end of the terminal fitting 30 and is crimped into connection with the electric wire 35 so that the electric wire 35 extends rearward from the terminal fitting 30. A primary lock 33 is formed on a lower surface of the box-shaped contact 31 and a secondary lock 34 is formed at the lower edge of the rear end of the box-shaped contact 31. The terminal fittings 30 are inserted into the cavities 11A, 11B from the rear side of the housing 10. The primary lock 33 of each terminal fitting 30 is locked to the lance 14 when the terminal fitting 30 is inserted into the respective cavity 11A, 11B to a predetermined normal position. Thus, the lance 14 holds the terminal fitting 30 inside the respective cavity 11A, 11B. The electric wire 35 extends rearward from the rear end surface 10R of the housing 10 when terminal fitting 30 is at the normal position, and the secondary lock 34 substantially aligns with the front edge 15F of the opening on the side surface of the mounting space 15.

The retainer 40 is made of synthetic resin and has a body 41 configured to fit in the mounting space 15 of the housing 10. The body 41 has the shape of an approximately right-angled triangle in a side elevation. An upper-stage removal prevention portion 42A is formed at the front edge of the upper surface of the body 41 and corresponds to the upper-stage cavities 11A. Through-holes 43 penetrate through the body 41 in the longitudinal direction of the housing 10 and correspond to the lower-stage cavities 11B. A lower-stage removal prevention portion 42B is formed at the lower front edge of each through-hole 43. An operation portion 44 extends down from the lower rear edge of the body 41, and continues across the entire width of the lower surface of the body 41. A central portion of the rear end surface of the operation portion 44 in the widthwise direction is tapered to form a finger-applying surface 44*a*.

The body 41 is formed over the whole length of the retainer 40 in its longitudinal direction. Left and right locking plates 45 project from opposite left and right ends of the body in a rear region of the retainer 40. A guide groove 46 is formed on each locking plate 45 and extends parallel with the guide ribs 18 of the housing 10. However, the guide grooves 46 are longer than the guide ribs 18. A main lock 47 is formed at the lower end of the rear edge of the locking plate 45. The locking plates 45 are capable of elastically deflecting out and away from one another.

The retainer 40 initially is mounted on the housing 10 at the temporary locking position. As a result, the body 41 of the retainer 40 penetrates into the mounting space 15 from the lower side of the housing 10, and the locking plates 45 are in the escape portions 16. More particularly, the locking plates 45 deflect elastically out during the initial mounting of the retainer 40 so that the guide ribs 18 and the locking projections 19 fit in the guide grooves 46. At the temporary locking position, as shown in FIG. 1, the rear edges of the locking plates 45 of the retainer 40 contact the front side of the protection rib 17. The front end 18F of the guide rib 18 contacts the front end 46F of the guide groove 46 from an obliquely downward and rearward position. Additionally, the main lock 47 contacts the rear end 46R of the guide groove 46 from an obliquely upward and forward position. These contacts prevent the retainer 40 from being displaced from the housing 10 in the longitudinal and vertical directions. Further, the left and right locking plates 45 sandwich the housing 10 and prevent the retainer 40 from being displaced from the housing 10 in the width direction.

Figure 3:
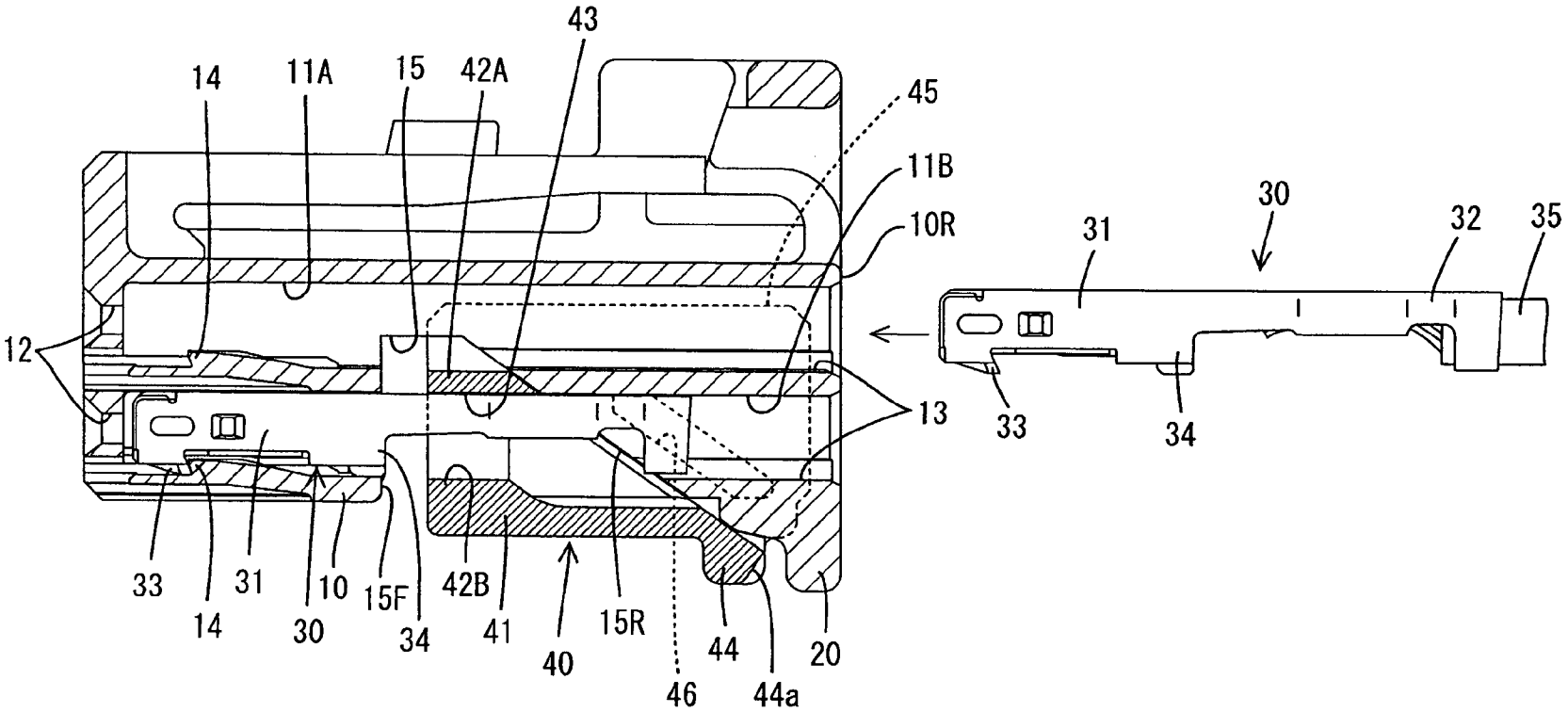
FIG. 3 is a vertical sectional view showing the state in which the retainer is disposed at the temporary locking position.

The upper-stage removal prevention portion 42A does not project into the upper-stage cavities 11A when the retainer 40 is at the temporary locking position, as shown in FIG. 3. Thus, the terminal fittings 30 can be inserted into and removed from the upper-stage cavities 11A when the retainer 40 is at the temporary locking position. Further the lower-stage removal prevention portion 42B does not project into the lower-stage cavities 11B when the retainer 40 is at the temporary locking position. Thus, the terminal fittings 30 can be inserted into and removed from the through holes 43 and the lower-stage cavities 11B when the retainer 40 is at the temporary locking position.

Figure 7:
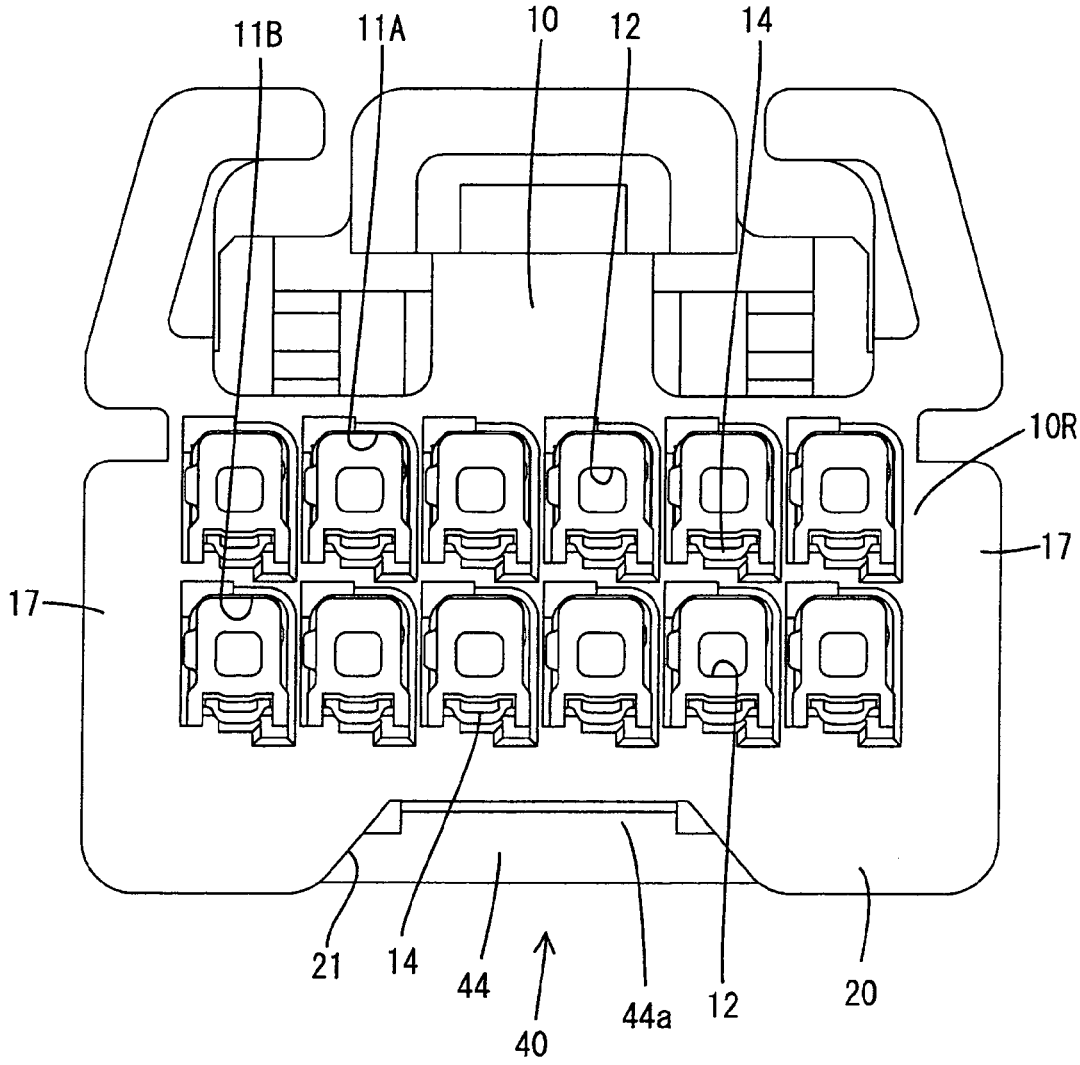
FIG. 7 is a rear elevation showing the state in which the retainer is disposed at the temporary locking position.

The lower edge of the operation portion 44 is slightly up from the lower edge of the interference prevention portion 20 when the retainer 40 is at the temporary locking position, as shown in FIGS. 1, 3, and 7. In other words, the operation portion 44 does not project down below the interference prevention portion 20. Therefore when some other member (not shown) approaches the housing 10 from a downward or rearward position, the other member contacts the interference prevention portion 20, but does not contact the operation portion 44 of the retainer 40. The widthwise central portion of the rear end surface of the operation portion 44 is exposed at the cut-out 21 when the housing 10 is viewed from the rear, as shown in FIG. 7. Therefore, the retainer 40 can be pressed obliquely up and forward at the cut-out 21 of the interference prevention portion 20 by applying a finger to the operation portion 44 from a position rearward or downward therefrom.

The terminal fittings 30 are inserted into all of the cavities 11A, 11B while the retainer 40 is at the temporary locking position. A finger then is applied to the section of the operation portion 44 exposed rearward and downward at the cut-out 21. The retainer 10 then is pressed obliquely up and forward along a direction intersecting the insertion direction of the terminal fitting 30 by applying. As a result, the locking plates 45 deform elastically out so that the locking plates 45 separate laterally from the escape portions 16 and so that the locking projections 19 unlock from the guide grooves 46. The guide ribs 18 remain fit in the guide grooves 46 to guide the retainer 40 linearly and obliquely up and forward.

Figure 2:
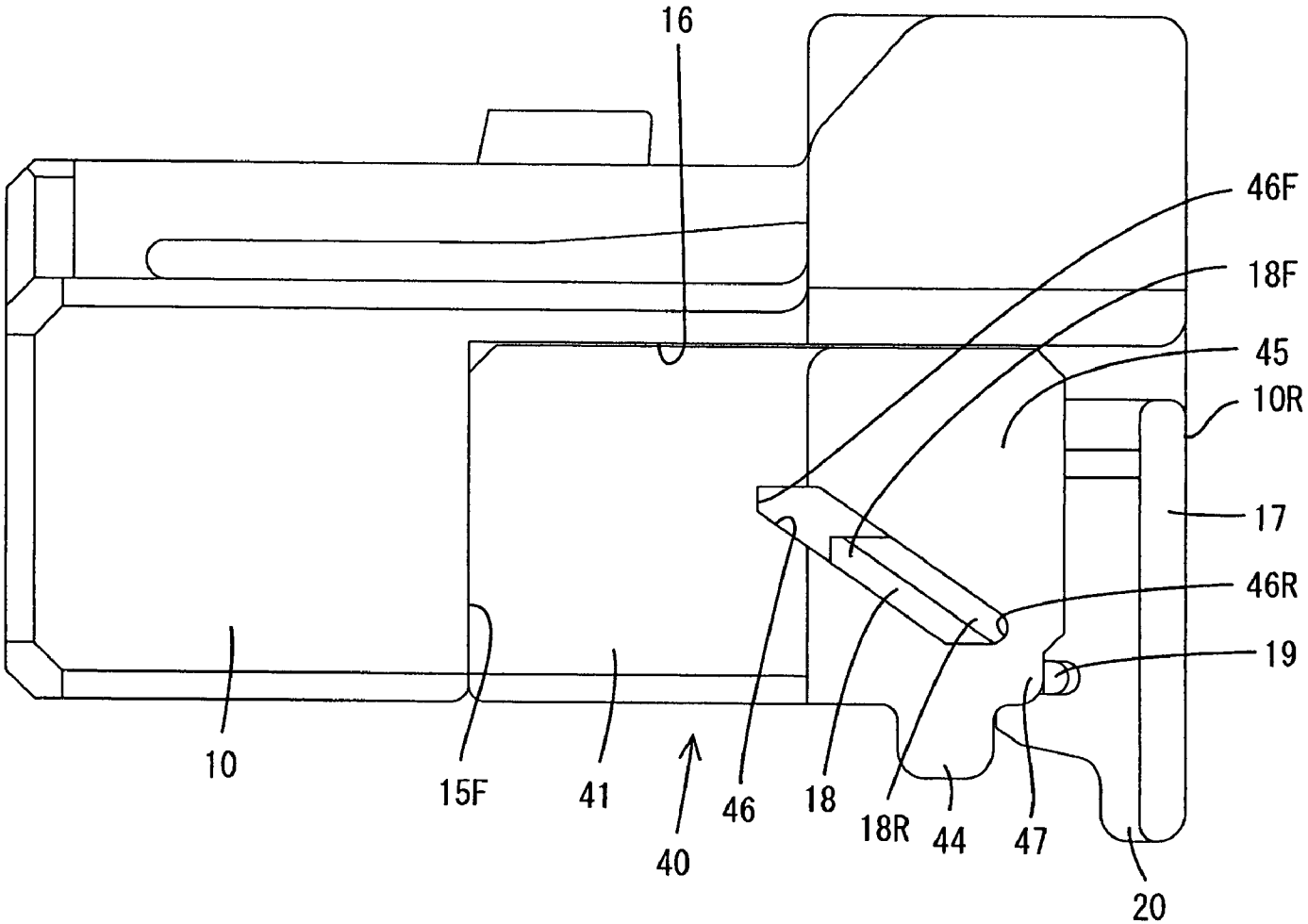
FIG. 2 is a side view showing a state in which the retainer is disposed at a main locking position.

The locking plates 45 return elastically inward to their original state when the retainer 40 reaches the main locking position. As a result, the rear end 46R of the guide groove 46 of the retainer 40 contacts the rear end 18R of the guide rib 18 of the housing 10 from an obliquely downward and rearward position, as shown in FIG. 2. At the same time, the main lock 47 of the retainer 40 contacts the locking projection 19 of the housing 10 from an obliquely upward and forward position. These contacts hold the retainer 40 at the main locking position and the retainer 40 is prevented from being displaced along the guide rib 18.

Figure 4:
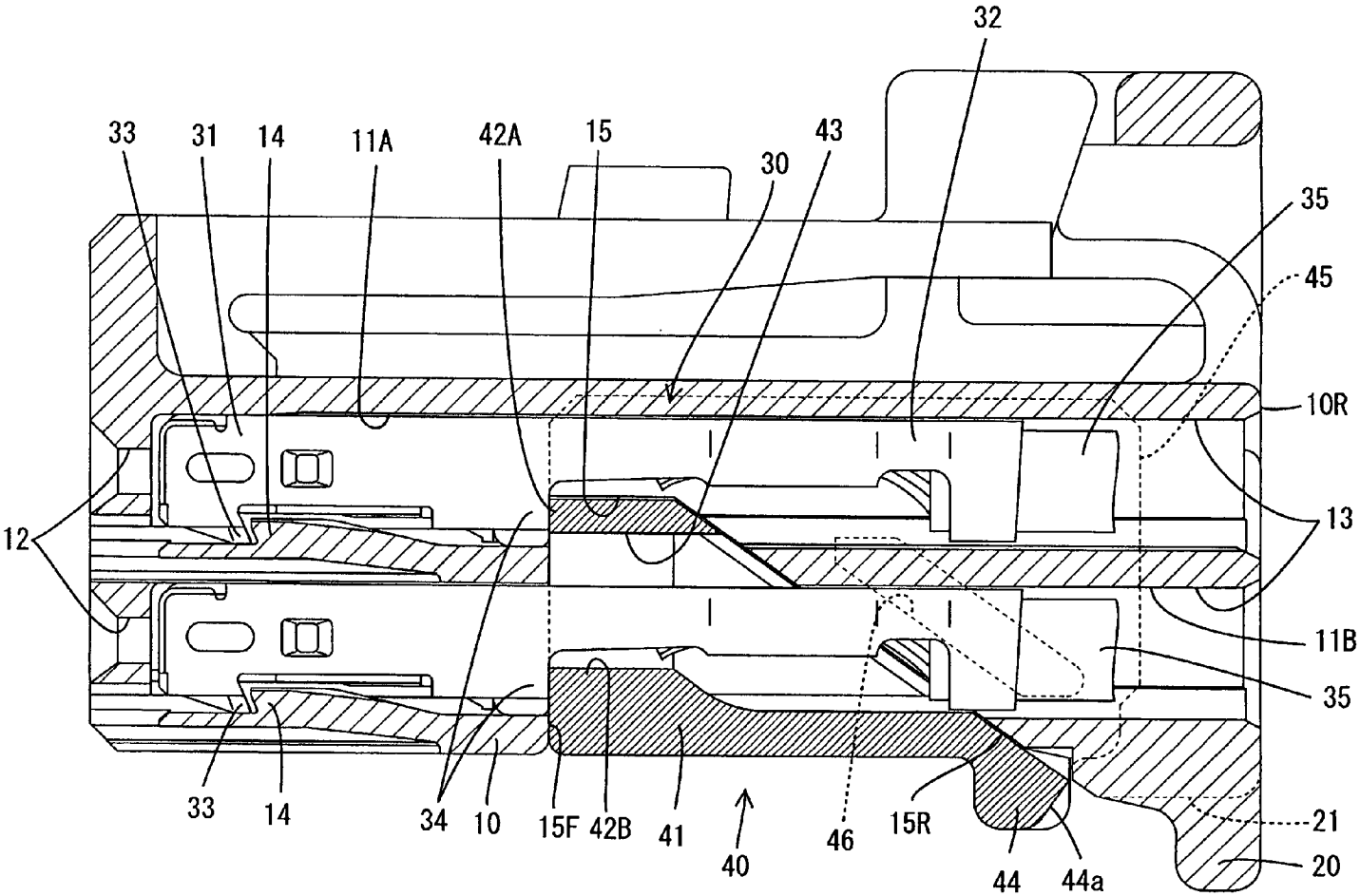
FIG. 4 is a vertical sectional view showing the state in which the retainer is at the main locking position.
Figure 5:
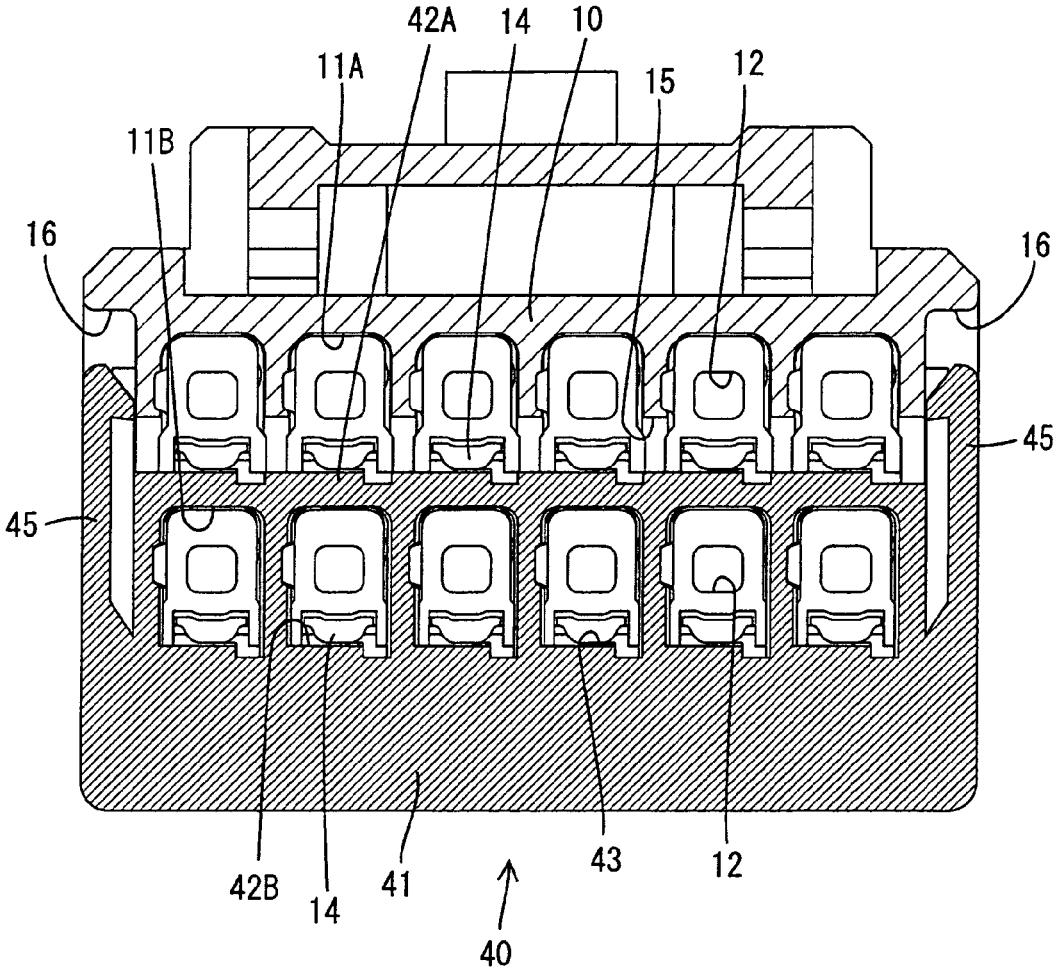
FIG. 5 is a transverse sectional view showing the state in which the retainer is disposed at the temporary locking position.
Figure 6:
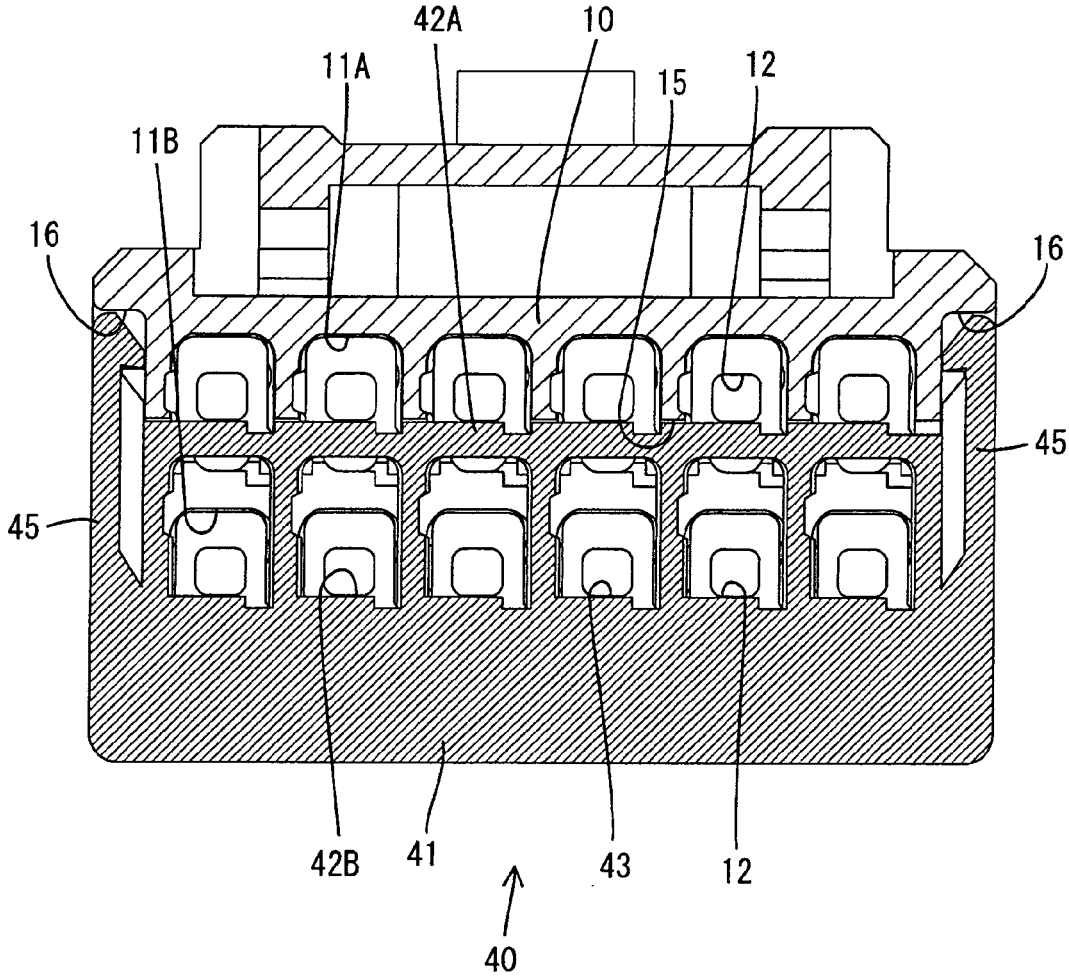
FIG. 6 is a transverse sectional view showing the state in which the retainer is disposed at the main locking position.

The upper-stage removal prevention portion 42A of the retainer 40 is rearward of and locked to the secondary lock 34 of the terminal fitting 30 in the upper-stage cavity 11A when the retainer 40 is at the main locking position, as shown in FIG. 4. At the same time, the lower-stage removal prevention portion 42B is rearward of and locked to the secondary lock 34 of the terminal fitting 30 in the lower-stage cavity 11B. As a result, the terminal fittings 30 are held securely in the cavities 11A, 11B.

Figure 8:
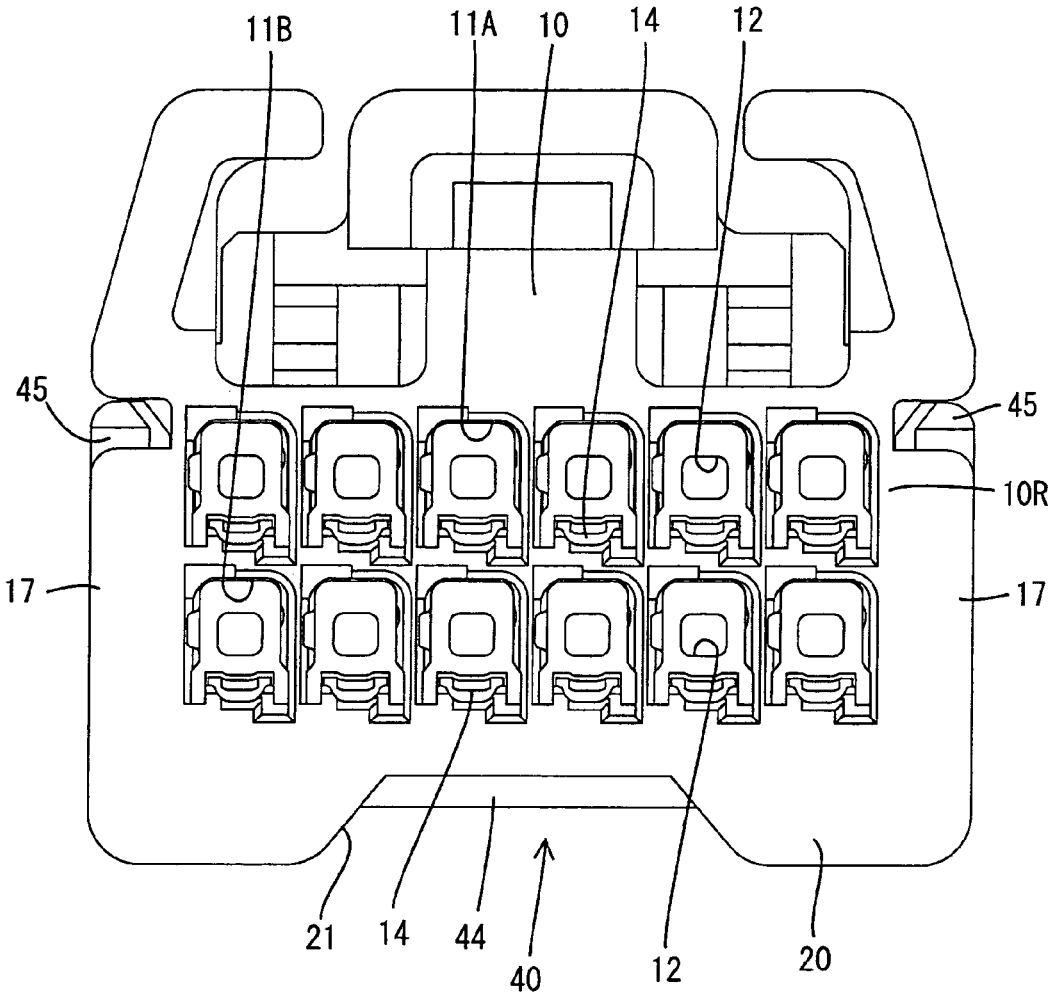
FIG. 8 is a rear elevation showing the state in which the retainer is disposed at the main locking position.

The lower edge of the operation portion 44 is exposed slightly to the rear at the cut-out 21 when the retainer 40 is at the main locking position, as shown in FIG. 8. In this state, it is possible to press the operation portion 44 at the cut-out 21 with the fingers over the whole stroke of a displacement region of the retainer 40 ranging from the temporary locking position to the main locking position. The lower surface of the retainer 40 is almost flush with the lower surface of the housing 10, when the retainer 40 is at the main locking position.

The assembling of the connector is completed by pressing the retainer 40 into the main locking position. The connector then can be fit in a hood (not shown) of the mating connector. More particularly, the region of the connector to be fit in the hood of the mating connector extends from the front end of the housing 10 substantially to the protection rib 17 and the interference prevention portion 20, including at least part of the retainer 40. Therefore, the interference prevention portion 20 does not interfere with an operation of fitting the connector in the hood of the mating connector, even though the interference prevention portion 20 projects down from the lower surface of the housing 10.

As described above, the interference prevention portion 20 is rearward from the retainer 40 and projects from the lower surface of the housing 10. The interference prevention portion 20 is capable of preventing some other member (e. g. another connector) from interfering with the retainer 40, when the retainer 40 is at the temporary locking position. The interference prevention portion 20 prevents other members from interfering with the retainer 40 during transport of the connector and enables the connector to be transported with the retainer 40 at the temporary locking position. Therefore it is possible to prevent other members from pressing the retainer 40 into the main locking position.

The interference prevention portion 20 is rearward from the retainer 40 and at the rear end of the housing 10. Therefore the interference prevention portion 20 does not interfere with an operation for fitting the housing 10 in a mating housing.

Further the interference prevention portion 20 has the cut-out 21 that allows the operation portion 44 of the retainer 40 disposed at the temporary locking position to be pressed manually from a position rearward and downward from the operation portion 44. Therefore it is easy to press the retainer 40 from the temporary locking position to the main locking position.

The interference prevention portion 20 is rearward from the retainer 40. Therefore if the displacement direction of the retainer 40 is orthogonal to the insertion direction of the terminal fitting 30, there is a fear that the retainer 40 will be displaced to the main locking position when a pressing force is applied from an obliquely forward position. In this embodiment, however, the direction of the displacement of the retainer 40 from the temporary locking position to the main locking position is forward and oblique to the insertion direction of the terminal fitting 30. Accordingly, a pressing force applied to the retainer 40 from an obliquely forward position will not press the retainer 40 into the main locking position.

Since the interference prevention portion 20 is flush with the rear end surface 10R of the housing 10, the housing 10 has a simple configuration.

The invention is not limited to the above-described and illustrated embodiment. For example, the following embodiments are included in the scope of the invention. Further, other modifications of the above-described embodiment can be made without departing from the spirit and scope of the invention.

The above-described retainer is displaced obliquely with respect to the insertion direction of the terminal fitting. However, the displacement direction of the retainer may be orthogonal to the insertion direction of the terminal fitting.

The displacement direction of the retainer from the temporary locking position to the main locking position is obliquely forward in the above described embodiment. However, the displacement direction of the retainer from the temporary locking position to the main locking position may be obliquely rearward.

The interference prevention portion is flush with the rear end surface of the housing. However, the interference prevention portion may be disposed forward from the rear end of the housing.

The above-described cut-out is formed on the interference prevention portion. However, the cut-out portion of the invention does not necessarily have to be on the interference prevention portion.

The cut-out is at the widthwise central position of the interference prevention portion. However, the cut-out may be spaced laterally with respect to the central position of the interference prevention portion in the widthwise direction or may be at an end of the interference prevention portion.

What is claimed is:

1. A connector comprising:

a housing with opposite front and rear ends and cavities extending between the ends for receiving terminal fittings from the rear end of the housing, opposite first and second side surfaces extending between the front and rear ends of the housing and opposite top and bottom surfaces extending between the front and rear ends of the housing, a retainer mounting space extending into the bottom surface of the housing and communicating with the respective cavities;

a retainer mounted to said housing for movement in a direction obliquely intersecting an insertion direction of said terminal fittings between a temporary locking position where insertion of said terminal fittings into said housing is allowed and a main locking position where said terminal fittings are held, and an operation portion projecting down from a rear part of the retainer; and an interference prevention portion substantially aligned with a rear part of the retainer and projecting down from the bottom surface of the housing a distance at least as far as the retainer when the retainer is in the temporary locking position, the interference prevention portion extending inwardly from the respective first and second side surfaces of the housing towards a middle part of the housing, a cut-out being formed in the interference prevention portion intermediate the opposite sides of the housing for permitting the operation portion of the retainer to be pressed from a position rearward from said retainer when said retainer is at said temporary locking position.

2. The connector of claim 1, wherein said interference prevention portion is flush with a rear end surface of said housing.

3. The connector of claim 1, wherein said interference prevention portion is unitary with the housing.

4. The connector of claim 1, wherein the retainer has locking plates engaging the sides of the housing.

5. The connector of claim 4, wherein the sides of the housing have escape recesses, the locking plates of the retainer being slidably disposed in the escape recesses.

6. A connector, comprising:

a housing with opposite front and rear ends and cavities extending between the ends for receiving terminal fittings from the rear end of the housing, the housing further having opposite sides extending between the front and rear ends, the sides of the housing being formed with escape recesses at locations spaced from the front and rear ends of the housing;

a retainer mounted to said housing for movement in a direction intersecting an insertion direction of said terminal fittings between a temporary locking position where insertion of said terminal fittings into said housing is allowed and a main locking position where said terminal fittings are held, the retainer having locking plates slidably disposed in the respective escape recesses;

an interference prevention portion projecting from an outer surface of the housing rearward of the retainer and extending between the sides of the housing, the interference prevention portion being formed with a cut-out that allows the retainer to be pressed from a position rearward from said retainer when said retainer is at said temporary locking position; and wherein the sides of the housing have protection ribs projecting outwardly at least as far as the locking plates at locations between the escape recesses and the rear end of the housing.

7. The connector of claim 6, wherein the protection ribs extend continuously from opposite widthwise ends of the interference protection portion.

8. The connector of claim 6, wherein a direction of a displacement of said retainer from said temporary locking position to said main locking position is forward and oblique to an insertion direction of said terminal fittings.

9. The connector of claim 6, wherein the interference prevention portion projects from the housing a distance at least as far as the retainer when the retainer is at the temporary locking position.

* * * * *